US006233756B1

(12) United States Patent
Holbrook, Sr.

(10) Patent No.: US 6,233,756 B1
(45) Date of Patent: May 22, 2001

(54) TRIPLE HEAD SHOWER SYSTEM

(76) Inventor: Alan E. Holbrook, Sr., 9407 Spring Branch, Dallas, TX (US) 75238

( * ) Notice: Subject to any disclaimer, the term of this patent is extended or adjusted under 35 U.S.C. 154(b) by 0 days.

(21) Appl. No.: 09/315,357

(22) Filed: May 17, 1999

(51) Int. Cl.[7] ..... A47K 3/22; A47K 3/28

(52) U.S. Cl. ..... 4/601; 4/567; 4/570; 4/615; 239/312

(58) Field of Search ..... 4/601, 567, 570, 4/615, 597; 239/310, 312, 315, 316, 379; 604/150

(56) References Cited

U.S. PATENT DOCUMENTS

| | | | | |
|---|---|---|---|---|
| 1,616,514 | * | 2/1927 | Swimmer | 4/570 |
| 2,228,626 | * | 1/1941 | Hetherington | 4/615 |
| 2,624,619 | * | 1/1953 | Fletcher et al. | 239/310 |
| 3,174,691 | * | 3/1965 | Haviland | 239/310 |
| 3,971,074 | * | 7/1976 | Yxfeldt | 4/570 |
| 4,933,080 | * | 6/1990 | Rundzaitis et al. | 4/615 |
| 5,148,556 | * | 9/1992 | Bottoms, Jr. et al. | 4/601 |
| 6,079,060 | * | 6/2000 | Walker | 4/601 |

* cited by examiner

*Primary Examiner*—Gregory L. Huson
*Assistant Examiner*—Tuan Nguyen

(57) ABSTRACT

An assembly for dispensing condensed liquids, powders, soap bars or soap chips into shower water being sprayed onto a user, by way of a triple shower spray and dispensing reservoir. The assembly is connected to water outlet supply in wall of bathing enclosure utilizing three conventional shower heads alined horizontally, equidistance from each other coupled thereto in a cross shape piping, controlled by four separate valves enabling the selective open and close passage of fluid therethrough. Two conventional flexible reservoirs, in vertical position containing bathing solutions, may be attach by threaded connection to piping on either side of center cross piping, being controlled by two of the valves, thus dispensing contents of reservoirs into shower water. Third valve controls flow of water into removable reusable reservoir, joined at lower outlet of piped assembly, reservoir being designed with upper threaded side outlet allowing the dispensing of an assortment of bathing solutions by the attachment of a variety of conventional flexible hoses. Forth valve located in center cross piping controls flow of fresh shower water used in bathing rinse only.

7 Claims, 3 Drawing Sheets

TRIPLE HEAD SHOWER SYSTEM

BACKGROUND OF THE INVENTION

1. Field of the Invention

The invention relates to the field of accessories for shower bathing. The dispensing of various soaps and liquids, medicinal and cosmetic as well as ordinary water spray shower may be accomplished by this method utilizing three shower spray outlets with two dispensing reservoirs controlled individually or simultaneously, in addition to a forth new unique bottle shaped reservoir outlet attached to bottom of assembly accommodating the use of a variety of hoses, spraying a mixture of medicinal or cosmetic solutions placed in described reservoir 2. Description of the Related Art The use of a multitude of showering fixtures is known in related art. The application of certain cosmetic and medicinal liquids to the entire body or parts thereof along with the normal showering process, using fixtures heretofore devised and utilized of known or basic familiar, obvious configurations. Whereas the incalculable number of designs encompassed by the innumerable prior art which have been developed in the culmination of countless objectives and requirements.

Known related art includes. U.S. Pat. No. 6,079,060 by Walker: U.S. Pat. No. 5,148,556 by Bottoms, Jr. et. al: U.S. Pat. No. 3,174,691 by Haviland: U.S. Pat. No. 2,624,619 by Fletcher. et al U.S. Pat. No. 2,228,626 by Hetherington While these contrivances fulfill their respective peculiarities and requirements, the above stated patents do not incorporate the embodiments of the triple head shower systems diverse simplicity of design and performance.

The inventive system consists of piping in a fork shaped configuration aligned horizontally connected thereto by a cross shaped fitting, forming three equally spaced apart fluid piping spray outlets allowing the coupling of standard spray heads. Each spray head positioned in standard outward water flow alignment Each piping outlet includes separate valves controlling the flow of fluid therethrough. Threaded adjacent inlet cup adapters, allowing the connection of standard flexible plastic bottles, or incorporated in piping on either side of center piping allowing the selective injection of various soaps and bathing liquids therefrom. The center piping which extends parallel and equidistant from outside piping, connected to cross fitting, completing the fork shape of assembly, incorporates the third dispensing outlet of system. Tee shaped fitting connected to center piping in a downward position, directs the flow of liquid into removable reusable container being controlled by way of Shut-off valve. Reusable container, bottle, canister, reservoir, designed with molded threaded male outlet at top side allows the attachment of various size flexible hoses, for the purpose of spraying pre-mixed solutions, medicinal or cosmetic soaps. All the feats of triple head shower are accomplished in simple workable design enabling its manufacture and installation at low cost and assures reliable operation.

Triple head shower may be used in conjunction with new and modern lines of Bathing soaps, lotions, shampoos and medicinal products.

SUMMARY OF THE INVENTION

Triple head shower system being an amelioration to the time proven common shower fixture, and its limited use of providing only a shower of water from the customary single spray outlet, as may be observed in general use today. A typical modern stall-shower or tub-shower installation may perhaps consist of a common single spray head utilizing a variety of adjustable spray openings controlling the intensity of water only. The general design, intention and object of the present invention is to facilitate a new multiple added convenience of not only shower bathing but being able to achieve the desired accomplishment of controlling the application of soaps, lotions, premixed solutions and medicinal liquids in one easy to use showering system. The present invention substantially departs from the disadvantages of the conventional concepts and designs of the prior art, in that it provides an apparatus capable of providing the embodiments utilized by a user in bathing consolidated into one fixture.

To attain this, the present invention generally comprises piping spaced apart in a three prong fork designed configuration positioned at typical shower height, being connected to supply-pipe water-outlet extending from the wall. The configuration evolves into three separate shower outlets parallel, equidistant and horizontally connected being controlled by way of separate selective open and close valves. Said shower outlets being adapted for the threaded connection of ordinary spray heads. Three prong fork design of fixture entails center piping outlet in parallel alinement, connecting two outside elongated piping outlets of design, constituting the triple shower system. Each outside piping outlet incorporates corresponding vertical Cup shaped threaded adapters allowing the coupling of common bottled solutions used in bathing. A fluidly connected removable reusable container attached at lower periphery of center piping outlet constituting a reservoir, having sufficient capacity to accommodate a supply of soaps, medicinal mixes and various bating solutions. Integrated in design of removable reusable container, in tangential alinement to apex of container is incorporated a threaded dispensing outlet allowing the attachment of various flexible hoses used in the spraying of bathing solutions.

It is therefore an object of the present invention to provide a new showering spray system fixture and procedure which succeeds in capturing many of the advantages of the showering fixtures alluded to previously and many innovative features that result in a new showering system apparatus which is not anticipated, interpreted obvious, suggested, or even implied by any of the prior art showering fixtures, either alone or in any combination thereof Still yet another object of the present invention is to provide a new showering spray system fixture which is capable of providing the devices and methods of the prior art and some of the advantages thereof, while simultaneously overcoming several of the disadvantages normally associated therewith.

An even further object of the present invention is to provide a new showering spray system fixture which reduces the need to apply soaps and lotions from individual bottles and the use of separate spray hoses used in applying various bathing solutions, all of these applications being preformed and accomplished in the use of triple shower system.

These objects of the invention, along with various features which characterize the invention, are pointed out with particularity in the claims eluded to and forming a part of this disclosure.

A BRIEF DESCRIPTION OF DRAWING SHEETS

The invention will be better understood and will become more apparent when consideration is given to the following detailed description thereof Such description makes reference to the annexed drawings herein. And accordingly a better understanding of the invention and the multiple uses are intended by referenced to the drawings which are considered as primarily representative and not to be therefore considered restrictive in nature.

Figure 3:
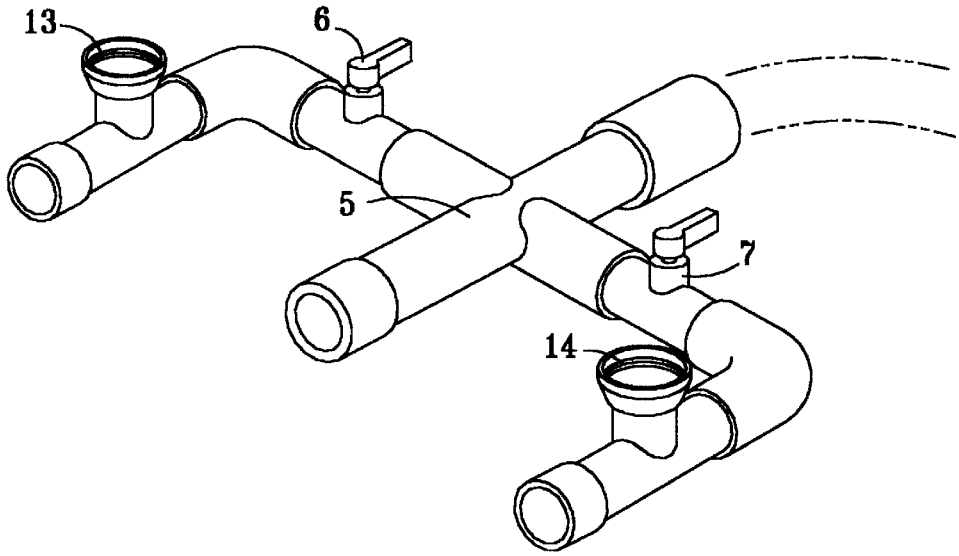
Figure 4:
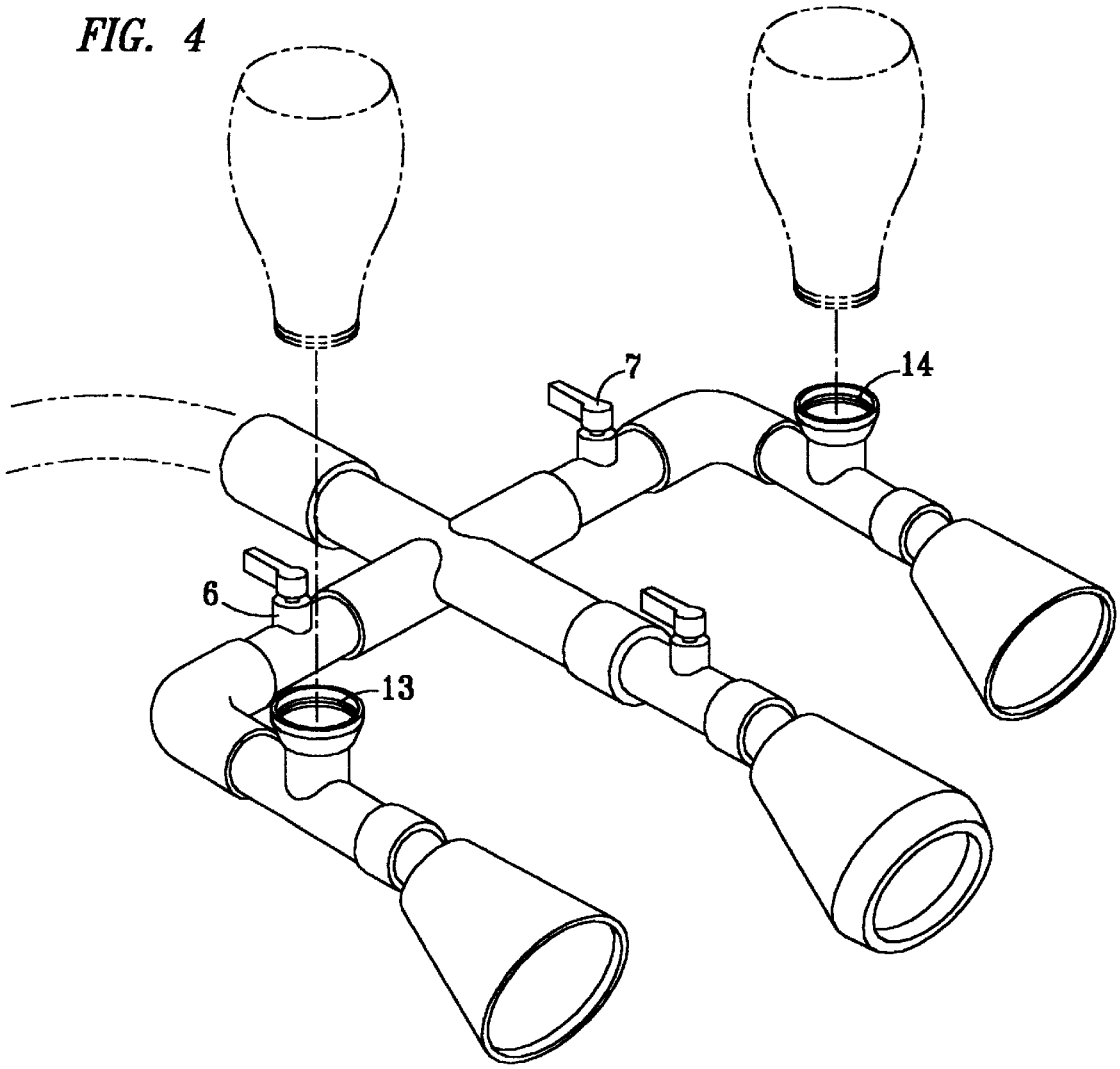
Figure 5:
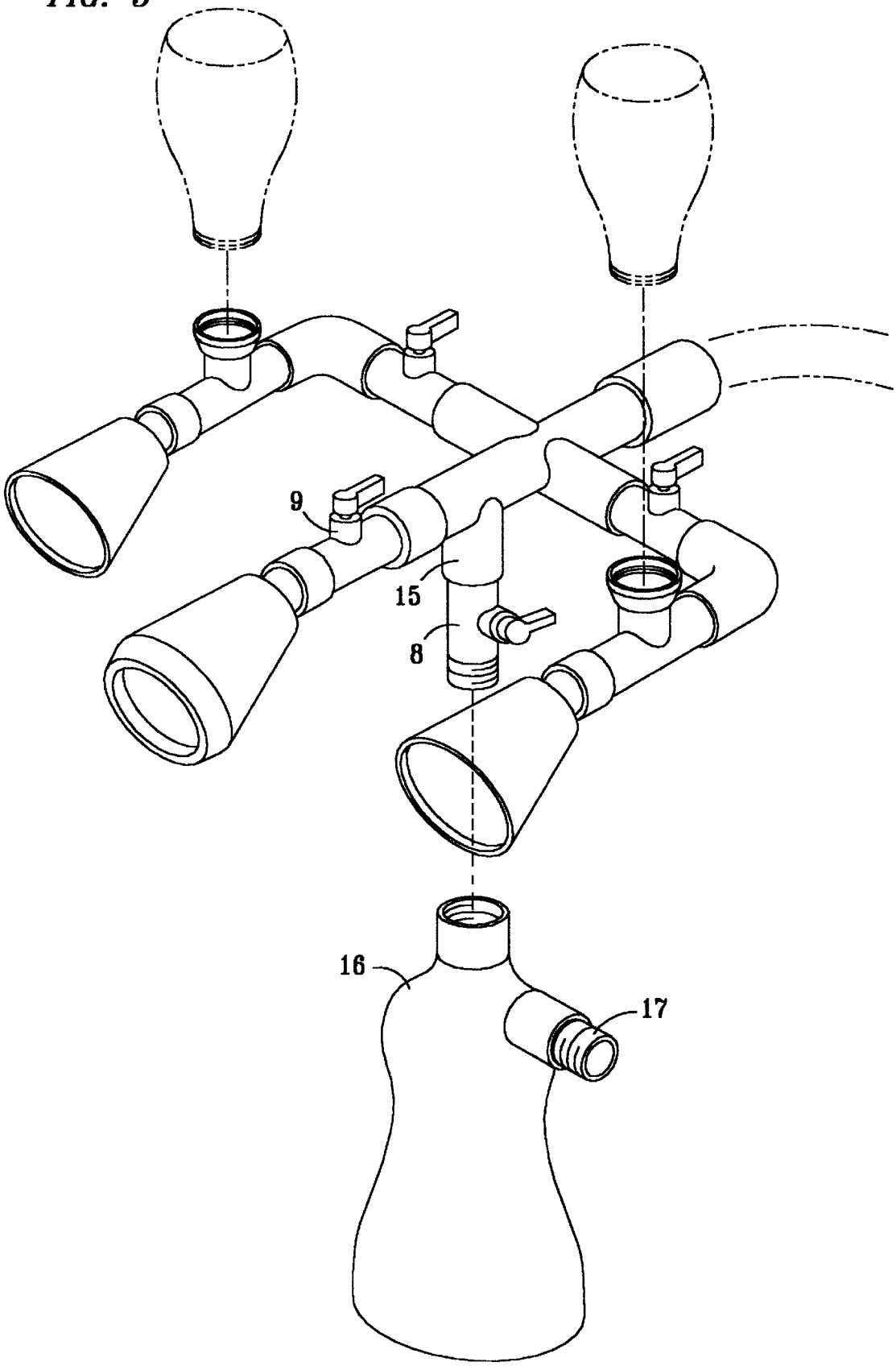

FIG. 3, is a detailed top side angle view showing location of shut-off valves, six and seven in horizontal position, controlling cupped adapters thirteen and fourteen FIG. 4, is a top inverted view showing cupped adapters on either side of cross section piping in horizontal alinement allowing the attachment of dispensing bottles FIG. 5, is a top side view showing total assembly of triple shower system, detailing removable reusable container's alined attachment at lower outlet shut-off valve, and features side dispensing outlet in upper side of container.

DETAILED DESCRIPTION OF THE INVENTION

Figure 1:
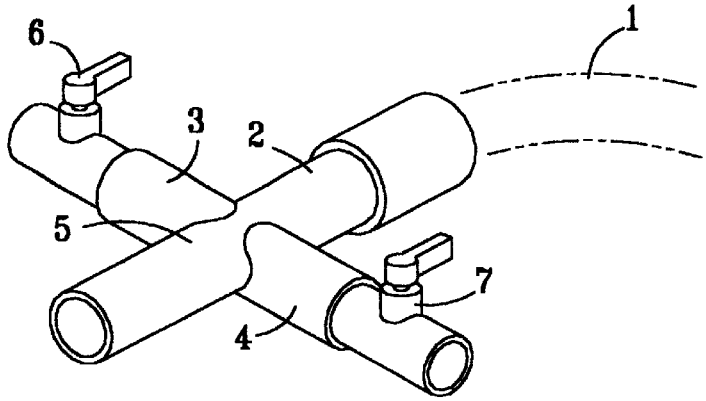
FIG. 1, is a pictorial view of a generic embodiment of the invention, showing essentially how it would appear installed in an existing shower-wall enclosure.
Figure 2:
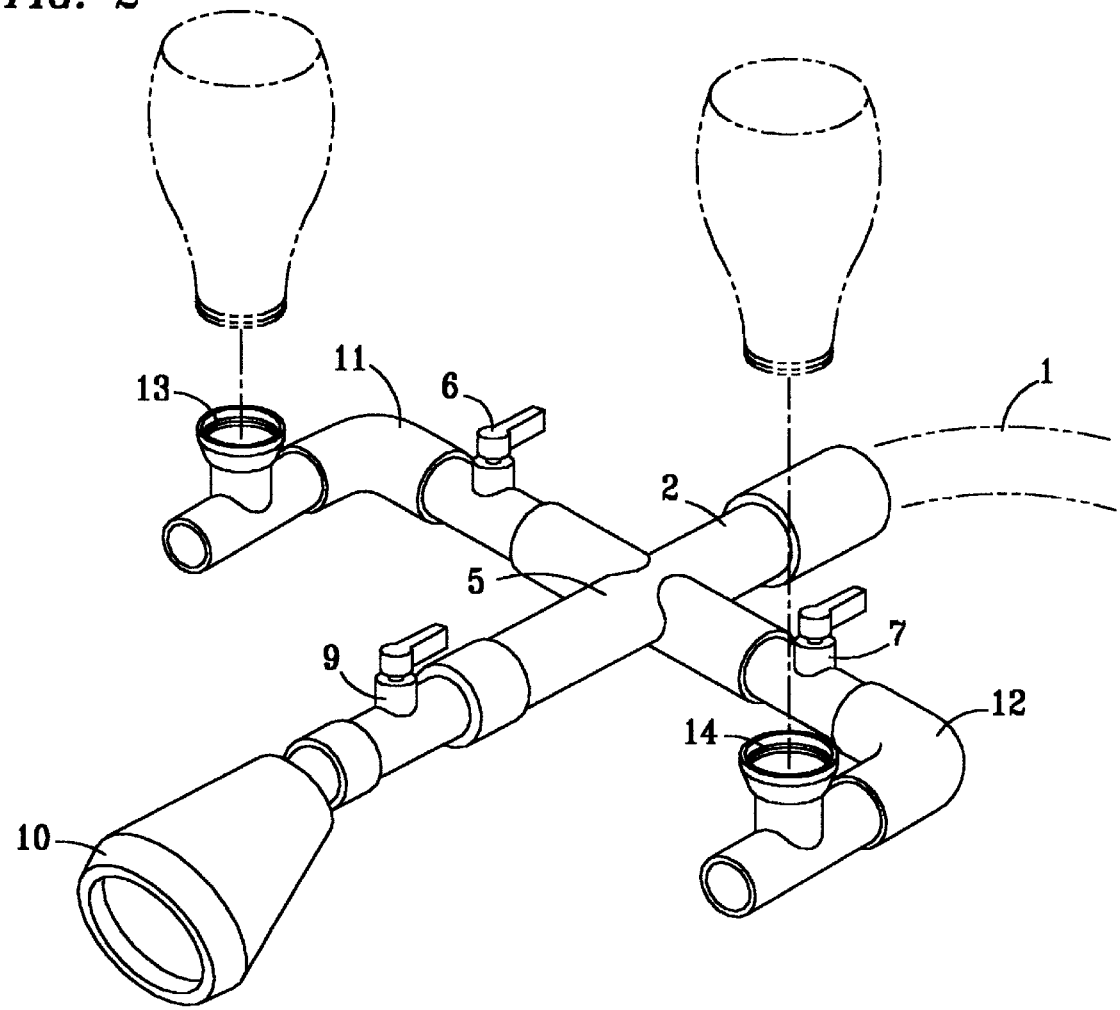
FIG. 2, is a top-side elevation section view wherein it reveals the preferred elements of construction showing the variant embodiment of the invention.

More specifically, FIGS. (1) through (5) depict the embodiment of applicant's invention. FIG. 1. For reference purposes the drawing sheets show shower outlet from shower wall (1) connected to shower assembly by threaded connection in a cross shaped fitting (2), Each outlet of cross fitting being fluidly connected to piping extending in an outward direction (3-4-5). Piping connected at side outlets (3-4) extends through valves (6-7) 6 FIG. 2. Shows center outlet piping (5), connected to cross fitting (2) and extending approximately five inches through horizontally attached valve (9).culminating in a male threaded outlet, allowing the attachment of a conventional shower head (10) The alignment of piping from each side outlet in cross fitting (2) extends through valves (6-7) connecting to ell shaped fittings (11-12). Piping extends through ell fittings approximately two inches engaging cupped shaped fittings (13-14) connected to piping in a horizontal position. Piping continues from said fittings approximately three inches culminating in like male threaded outlets allowing the attachment of conventional shower heads. Piping and fittings on either side of center assembly are duplicate in function and aligned parallel to center assembly.

FIG. 3. Shows cupped cone shaped female threaded fittings (13-14), in equidistant position on either side of center piping (5). Each cupped fitting being horizontally aligned, spaced apart from valves (6-7) allowing the passage of fluid therethrough FIG. 4. Shows complete shower assembly detailing cupped shaped fittings (13-14) being controlled by way of valves (6-7).Threaded portion of cupped fittings allows the connection of multiple variations of common flexible dispensing bottles which are adaptable to common thread size .The contents of bottles in liquid or powder form are induced into water flow through cupped fittings, controlled independently using adjustment of valves.

FIG. 5. Shows tee shaped fitting (15) attached to piping (5) with side outlet of tee in downward position allowing connection of valve (8) which controls water flow into threaded attached reusable container (16). Threaded attachment of container permits removal and re-attachment to lower assembly. Container my be filled with various premixed solutions, medicinal or cosmetic soaps. Molded male threaded outlet at top side of container (17), allows the attachment of conventional flexible hoses used in spraying premixed solutions.

The foregoing description is merely considered as an illustration of the principles of the invention. Since numerous modifications and changes such as dimensions, sizes, materials, function and manner of operation, and assembly and use will readily occur to those skilled the art, it is not desired to limit the invention to the exact construction and operation shown and described. Accordingly, all suitable modifications and equivalents may be resorted to, falling within the scope of the invention.

What is claimed is:

1. A combination water showering and soap dispensing system for connecting to an existing fresh water wall outlet in a shower enclosure, said system comprising:

a combination of four water dispensing piping outlets, each of said piping outlets having a valve for controlling the flow of clean water or the flow of water and bathing solutions from a bottle;

three of said four water dispensing piping outlets are horizontally aligned and fluidly connected to said fresh water wall outlet for directing the flow of water and the bathing solutions outwardly in the same direction, said three horizontally aligned piping outlets comprise of a central piping outlet and opposing equidistantly spaced apart left and right piping outlets connected to said central piping outlet, each of said left and right piping outlets comprises an inlet adapted to receive said bottle for mixing said bathing solutions with the water;

a shower head is threadedly attached to each of said three horizontally aligned piping outlets for directing the flow of the fresh water from said central piping outlet and the mixture of water and bathing solutions from said left and right piping outlets;

a removable and reusable container having an inlet and adapted to be filled or refilled with premixed solutions of medicinal liquids or powders of hygienic function; and the fourth piping outlet of said four water dispensing piping outlets is perpendicularly connected to said central piping outlet in a downward position for allowing the downward flow of water into said inlet of said removable and reusable solution container connected thereto.

2. The system of claim 1, wherein said system further comprises a cross-shaped fitting having an inlet adapted to be connected to the fresh water wall outlet in a shower enclosure and multiple outlets connecting to said piping outlets to form a three fork shape.

3. The system of claim 1, wherein the bathing solutions comprise of one of liquid soaps, powders, soaps, cosmetic products, lotion and medicinal solutions.

4. The system of claim 1, wherein said inlet of said removable and reusable container is threadedly connected to said fourth piping outlet for allowing the circulation and blending of the premixed solutions therein.

5. The system of claim 4, wherein said removable and reusable container further comprises a threaded discharge outlet in the upper side thereof for attaching various common size and length flexible hoses of conventional spray attachments.

6. The system of claim 1, wherein said inlet of said left and right piping outlets is a threaded cup adapter protruding perpendicularly upward from said left and right piping outlets so that said bathing solutions bottle can be threadedly attached thereto for dispensing the bathing solutions into the water.

7. The system of claim 6, wherein the threaded cup adapters is adapted to receive various bottles, decanters, and vials.

* * * * *